US010899535B2

(12) United States Patent
Häfker

(10) Patent No.: US 10,899,535 B2
(45) Date of Patent: Jan. 26, 2021

(54) PACK FOR CIGARETTES AND METHOD AND APPARATUS FOR PRODUCING SAID PACK

(71) Applicant: Focke & Co. (GmbH & Co. KG), Verden (DE)

(72) Inventor: Thomas Häfker, Langwedel (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 156 days.

(21) Appl. No.: 16/318,330

(22) PCT Filed: Aug. 2, 2017

(86) PCT No.: PCT/EP2017/001109
§ 371 (c)(1),
(2) Date: Jan. 16, 2019

(87) PCT Pub. No.: WO2018/024375
PCT Pub. Date: Feb. 8, 2018

(65) Prior Publication Data

US 2019/0225410 A1 Jul. 25, 2019

(30) Foreign Application Priority Data

Aug. 3, 2016 (DE) ..... 10 2016 114 350

(51) Int. Cl.
*B65D 85/10* (2006.01)
*B65B 19/02* (2006.01)
(Continued)

(52) U.S. Cl.
CPC ..... *B65D 85/1027* (2013.01); *B65B 19/025* (2013.01); *B65B 19/28* (2013.01);
(Continued)

(58) Field of Classification Search
CPC ..... B65D 85/1045; B65D 85/1027; B65D 85/1018; B65D 75/5838; B65D 2575/586; B65D 77/206; B65D 75/5894; A24F 15/12
See application file for complete search history.

(56) References Cited

U.S. PATENT DOCUMENTS

2007/0131233 A1 6/2007 Degliesposti
2011/0226640 A1 9/2011 Bertuzzi
(Continued)

FOREIGN PATENT DOCUMENTS

CN 103958369 A 7/2014
CN 104507823 A 4/2015
(Continued)

OTHER PUBLICATIONS

Deutsches Patent—Und Markenamt (German Patent and Trademark Office), Recherchenbericht (search in a related application), Mar. 23, 2017.
(Continued)

*Primary Examiner* — Mollie Impink
(74) *Attorney, Agent, or Firm* — Laurence P. Colton; Smith Tempel Blaha LLC

(57) ABSTRACT

A pack for cigarettes having an outer pack and an inner pack with a blank that surrounds a cigarette group, the inner pack having a removal opening for accessing the pack contents, and the inner pack having a closure flap fastened to it by a releasable adhesive bond and being removable for access to the removal opening or pack contents. For forming the removal opening, the blank has an opening that is closable by the closure means, the closure means having a coverage region that, with the closure means in the closed position, circumferentially surrounds the opening and is adhesively connectable to a region of the blank that surrounds the opening, and a separate blank is adhesively fastened on the
(Continued)

closure means on the side facing the inner pack, the separate blank, with the closure means in the closed position, covering the opening and overlapping the opening on all sides.

17 Claims, 6 Drawing Sheets

(51) Int. Cl.
*B65B 61/18* (2006.01)
*B65B 19/28* (2006.01)

(52) U.S. Cl.
CPC ..... *B65B 61/184* (2013.01); *B65D 85/1045* (2013.01); *B65D 85/1081* (2013.01)

(56) References Cited

U.S. PATENT DOCUMENTS

| | | | | |
|---|---|---|---|---|
| 2018/0105340 | A1* | 4/2018 | Bellamah | B65D 65/02 |
| 2018/0354695 | A1* | 12/2018 | Bourgoin | B65D 75/5838 |

FOREIGN PATENT DOCUMENTS

| | | | |
|---|---|---|---|
| DE | 102008035467 | A1 | 2/2010 |
| DE | 102009034705 | A1 | 1/2011 |
| DE | 102011119344 | A1 | 4/2013 |
| DE | 102014011396 | A1 | 2/2016 |
| EP | 2310300 | A1 | 4/2011 |
| WO | 2002079051 | A1 | 10/2002 |
| WO | 2010012370 | A1 | 2/2010 |
| WO | 2013053408 | A1 | 4/2013 |
| WO | 2016087818 | A1 | 6/2016 |

OTHER PUBLICATIONS

WIPO, International Search Report (in the parent application), dated Dec. 4, 2017.

China National Intellectual Property Administration, Notification of the First Office Action (in a related application), dated Dec. 27, 2019.

* cited by examiner

PACK FOR CIGARETTES AND METHOD AND APPARATUS FOR PRODUCING SAID PACK

CROSS REFERENCE TO RELATED APPLICATIONS

This application is the US National Phase of and claims the benefit of and priority on International Application No. PCT/EP2017/001109 having a filing date of 2 Aug. 2017, which claims priority on and the benefit of German Patent Application No. 10 2016 114 350.2 having a filing date of 3 Aug. 2016.

BACKGROUND OF THE INVENTION

Technical Field

The invention relates to a pack for cigarettes having an outer pack, preferably realized as a hinge-lid pack with a packet part and a lid which is mounted on the packet part so as to be pivotable, and having an inner pack with a blank produced from packing material which surrounds at least one cigarette group as pack contents preferably substantially on all sides, wherein the inner pack comprises a removal opening in order to make it possible for the consumer to access the pack contents, and wherein the inner pack comprises a closure means, in particular a closure flap, which is fastened to the inner pack by means of at least one partially releasable adhesive bond and is removable from the inner pack for access to the removal opening or to the pack contents.

In addition, the invention relates to a corresponding method for producing a pack for cigarettes having an outer pack, preferably realized as a hinge-lid pack with a packet part and a lid which is mounted on the packet part so as to be pivotable, and having an inner pack with a blank produced from packing material which surrounds at least one cigarette group as pack contents substantially on all sides, wherein the inner pack comprises a removal opening in order to make it possible for the consumer to access the pack contents, and wherein the inner pack comprises a closure means, in particular a closure flap which is fastened to the inner pack by means of at least one partially releasable adhesive bond and is removable from the inner pack for access to the removal opening or to the pack contents, and to an apparatus for producing a pack for cigarettes having an outer pack, preferably realized as a hinge-lid pack with a box part and a lid which is mounted on the box part so as to be pivotable, and having an inner pack with a blank produced from a packing material which surrounds at least one cigarette group as pack contents preferably substantially on all sides, wherein the inner pack comprises a removal opening in order to make it possible for the consumer to access the pack contents, and wherein the inner pack comprises a closure means, in particular a closure flap, which is fastened to the inner pack by means of at least one partially releasable adhesive bond and is removable from the inner pack for access to the removal opening or to the pack contents.

Prior Art

Such packs are known in the prior art. A problem in this case is in part that the adhesives, which are used to bond the closure means to the inner pack, could impair the pack contents.

BRIEF SUMMARY OF THE INVENTION

Proceeding from here, the object underlying the invention is to develop further packs of the type named in the introduction, in particular with regard to improved protection of the pack contents from harmful influences.

To achieve said object, a pack according to the invention comprises an outer pack, preferably realized as a hinge-lid pack with a box part and a lid which is mounted on the box part so as to be pivotable, and having an inner pack with a blank produced from packing material which surrounds at least one cigarette group as pack contents preferably substantially on all sides, wherein the inner pack comprises a removal opening in order to make it possible for the consumer to access the pack contents, and wherein the inner pack comprises a closure means, in particular a closure flap, which is fastened to the inner pack by means of an at least partially releasable adhesive bond and is removable from the inner pack for access to the removal opening or to the pack contents, characterized in that, for forming the removal opening, the blank is provided with an opening which is closable by the closure means, wherein the closure means comprises a coverage region which, with the closure means in the closed position, surrounds the opening on all sides or circumferentially and is connectable by means of adhesion to a region of the blank which surrounds the opening circumferentially, and in that a (separate) blank produced from packing material is fastened by means of adhesion on the closure means on the side pointing to the inner pack, said (separate) blank, with the closure means in the closed position, covering the opening entirely and projecting beyond an edge of the opening on all sides with an overlap region (X). It is accordingly provided that, for forming the removal opening, the blank is provided with an opening which is closable by the closure means, wherein the closure means comprises a coverage region which, with the closure means in the closed position, surrounds the opening on all sides or circumferentially and is connectable by means of adhesion to a region of the blank which surrounds the opening circumferentially, and that a blank produced from packing material is fastened by means of adhesion on the closure means on the side pointing to the inner pack, said blank, with the closure means in the closed position, covering the opening entirely and projecting beyond an edge of the opening on all sides with an overlap region.

The advantage of said solution is, in particular, that direct contact between the adhesive bond and the pack contents is avoided or at least made difficult by the blank which is provided on the underside of the closure. Furthermore, the blank also forms a barrier for substances which possibly emerge from the adhesive bond and are likely to influence the quality of the pack contents.

According to a preferred further development of the invention, it is provided that the blank which is provided on the closure means comprises smaller dimensions than the closure means, wherein the closure means overlaps the blank on all sides or circumferentially, in such a manner that the closure means is bondable to the inner pack all around the blank.

In a preferred design of the invention, it can be provided that the closure means is provided with an adhesive layer on the side surface pointing to the inner pack, wherein the adhesive layer preferably extends over the entire side surface (with the exception of a region of an actuating flap).

According to a further characteristic, it can preferably be provided that the adhesive layer comprises regions of varying intensity or strength of adhesion, in particular in such a manner that in a region of the beginning of the opening, when the closure means is actuated, an adhesive zone with a comparatively weaker adhesive action is realized, followed by an adhesive zone with a comparatively stronger adhesive action and a further adhesive zone with a higher adhesive action.

A further characteristic can preferably consist in that the closure means or an actuating flap of the same is connected (permanently) to the inside surface of a lid front wall of the outer pack, preferably by means of a glue strip and/or glue dots on the free outside surface of the actuating flap.

A further characteristic can consist in that the blank on the side pointing to the cigarette group comprises a layer produced from a pulp, in particular a paper layer.

A method according to the invention is a method for producing a pack for cigarettes having an outer pack, preferably realized as a hinge-lid pack with a packet part and a lid which is mounted on the packet part so as to be pivotable, and having an inner pack with a blank produced from packing material which surrounds at least one cigarette group as pack contents substantially on all sides, wherein the inner pack comprises a removal opening in order to make it possible for the consumer to access the pack contents, and wherein the inner pack comprises a closure means, in particular a closure flap which is fastened to the inner pack by means of at least one partially releasable adhesive bond and is removable from the inner pack for access to the removal opening or to the pack contents, characterized in that first of all a removal opening is provided on the blank and in that in the next step the closure means for the removal opening is provided in a situationally correct manner on the blank in the region of the removal opening, wherein, prior to the provision on the blank for the inner pack, a (separate) blank produced from packing material is provided on the closure means in such a manner that, once the closure means has been provided on the blank, it covers the removal opening on all sides or circumferentially and is itself covered on all sides or circumferentially by the closure means. It is accordingly provided that first of all a removal opening is arranged on the blank and that in the next step the closure means for the removal opening is arranged in a situationally correct manner on the blank in the region of the removal opening, wherein, prior to the provision on the blank for the inner pack, a (separate) blank produced from packing material is provided on the closure means in such a manner that, once the closure means has been provided on the blank, it covers the removal opening on all sides or circumferentially and is itself covered on all sides or circumferentially by the closure means.

The situationally correct provision of the blanks on the closure means, on the one hand, and the situationally correct provision of the closure means on the blanks, on the other hand, is preferably monitored by sensors and drives of members of the packing machine are controlled correspondingly for transporting the closure means and/or the blanks for the situationally correct provision.

According to a preferred further development, it can be provided that the closure means are detached from a continuous carrier strip as a result of deflection of the same and are transferred to an application roller, wherein the closure means are transported in such a manner on the application roller that a side of the closure means provided with adhesive is remote from the surface of the application roller, and that blanks are transferred to the closure means located on the application roller and are fastened thereto as a result of bonding.

The interconnected closure means and blanks can be provided by the application roller on a continuous material web for blanks for the inner pack or on individual blanks for the inner pack, namely in a situationally correct manner at the openings, provided in the material web or the blanks, for the removal opening.

An apparatus according to the invention is an apparatus for producing a pack for cigarettes having an outer pack, preferably realized as a hinge-lid pack with a box part and a lid which is mounted on the box part so as to be pivotable, and having an inner pack with a blank produced from a packing material which surrounds at least one cigarette group as pack contents preferably substantially on all sides, wherein the inner pack comprises a removal opening in order to make it possible for the consumer to access the pack contents, and wherein the inner pack comprises a closure means, in particular a closure flap, which is fastened to the inner pack by means of at least one partially releasable adhesive bond and is removable from the inner pack for access to the removal opening or to the pack contents, characterized by a hole cutting apparatus for providing a removal opening on the blank, an application roller which is arranged downstream of the hole cutting apparatus for providing the closure means on the blank in the region of the removal opening, wherein a (separate) blank produced from packing material is providable on the closure means on the application roller in such a manner that, once the closure means has been provided on the blank, it covers the removal opening on all sides or circumferentially and is covered itself on all sides or circumferentially by the closure means. It is accordingly provided that a hole cutting apparatus is provided for making a removal opening on the blank, in addition an application roller which is arranged downstream of the hole cutting device for providing the closure means on the blank in the region of the removal opening, wherein a (separate) blank produced from packing material is providable on the closure means on the application roller in such a manner that, once the closure means has been provided on the blank, it covers the removal opening on all sides or circumferentially and is covered itself on all sides or circumferentially by the closure means.

It is preferably provided that the blank is suppliable by means of a transfer roller to the closure means held on the application roller.

It can additionally be provided that the supplying of the closure means to the application roller is controllable by means of a sensor and/or that the supplying of the blank to the application roller is controllable by means of a sensor and/or that the supplying of the closure means with the application roller is controllable by means of a sensor and/or in that the supplying of the blanks or of a corresponding material web into the region of the application roller is controllable by means of a sensor.

It can also be provided that the members of the apparatus are controlled by drive motors in accordance with the data acquired by the sensors in such a manner that the closure means with blanks mounted thereon are arranged in a situationally correct manner in the region of the removal opening.

BRIEF DESCRIPTION OF THE DRAWINGS

Preferred exemplary embodiments of the invention are explained below by way of the drawing, in which.

DETAILED DESCRIPTION OF PREFERRED EMBODIMENTS

Figure 2:
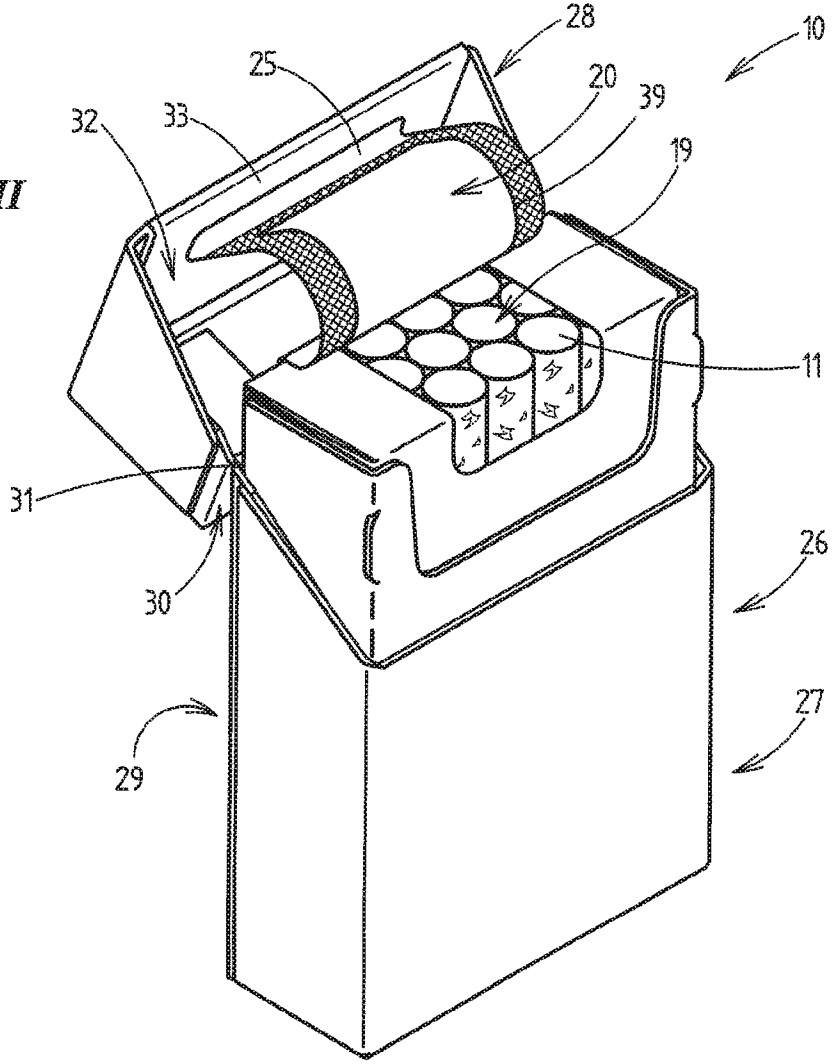
FIG. 2 shows an open inner pack according to FIG. 1 in an outer pack with an open lid.

The exemplary embodiments of the drawings are concerned with the design of packs 10 for cigarettes 11. A formed cigarette group, consisting namely of rows, is the content of an inner pack 12. It consists in the first exemplary embodiment of preferably one blank 13 produced from foil, in particular from a moisture-tight and aroma-tight foil.

The group of cigarettes 11 is preferably wrapped around completely, i.e. on all sides, by the blank 13, thereby forming a so-called sealed block with an inner front wall 14, inner rear wall 15, inner side walls 16, inner bottom wall 17 and inner end-face wall 18.

The blank 13 is realized or folded around the group of cigarettes 11 in such a manner that the inner end-face wall 18 is free of folds but forms a continuously closed wall. An opening aid is provided in said region, making easy, in particular automatic, access to the pack contents possible. For this purpose, the inner pack 12 comprises a removal opening 19 in the end-face region. The removal opening 19 extends in the region of the inner end-face wall 18 and in a connecting end-face part piece of the inner front wall 14. The removal opening 19 is preferably arranged centrally and has a (clearly) smaller width than the inner pack 12.

The removal opening 19—with the pack 10 closed—is covered by a closure means, in particular a closure flap 20. It covers the removal opening 19 preferably completely and preferably forms a strip-shaped protrusion all around. In the region of an anchoring strip 21, the closure means is permanently connected to the inner pack 12, in particular in the region of the inner rear wall 15. Edge strips 22, 23, 24 are connected to the inner pack 12 by means of adhesion, in each case in an edge strip surrounding the removal opening 19. The edge strips 22, 23, 24 are fixed with releasable and multiple-use adhesive, in particular so-called PSA adhesive.

The closure means is provided with a grip or actuating flap 25 in an end region, namely in the region of a leg which projects into the inner front wall 14. Said grip or actuating flap is preferably glue-free on the side facing the inner front wall 14 and is able to be grasped as a result. The actuating flap 25 extends preferably over the entire width of the closure means as an edge strip of the same.

A characteristic consists in that the actuating flap 25, in the case of the exemplary embodiments shown, is connected to a movable part of an outer pack 26. The outer pack here is a hinge-lid box with a box part 27 and lid 28. Said lid is connected to the box part 27 so as to be pivotable via a line joint 31 by way of a lid rear wall 30 in the region of a box rear wall 29.

The closure means is connected to the lid 28 in such a manner that when the same is opened, the closure flap 20 also moves into the open position (FIG. 2). To this end, the actuating flap 25 is connected to the lid 28 preferably in the region of a lid front wall 32. This is effected preferably by means of glue or by means of a glue strip which extends in the longitudinal direction of the actuating flap 25 or by means of a corresponding group of glue dots.

The glue is preferably applied on the outside of the actuating flap 25. When the pack is being produced or when the inner pack 12 in inserted into the outer pack 26, the connection to the actuating flap 25 is produced by means of the glue when the lid 28 is in the closed position. A lid inner tab 33 is preferably provided on the inside of the lid front wall 32. The actuating flap 25 is preferably (permanently) connected to said lid inner tab. When the lid 28 is closed, the closure means also returns into the closed position (FIG. 1).

Figure 1:
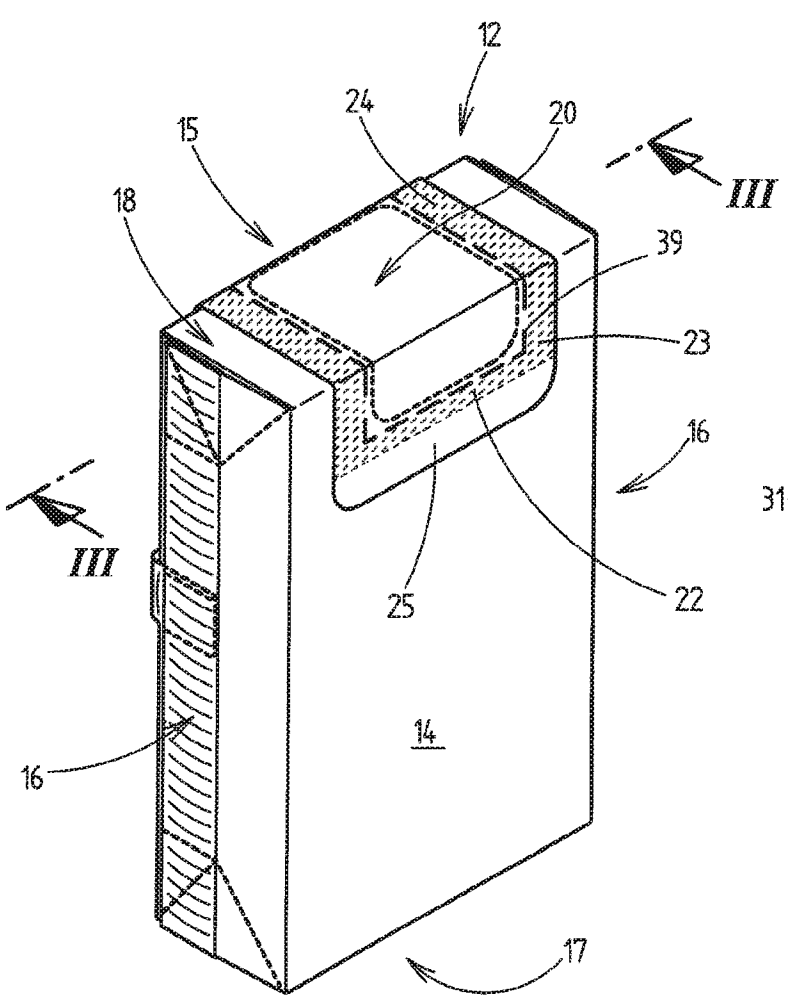
FIG. 1 shows a spatial representation of a closed inner pack.

The inner pack 12 is realized as a sealed block in the first exemplary embodiment, according to FIG. 1 with a cover fold in the region of the inner side walls 16. Fold tabs which cover one another are also provided in the region of the inner rear wall 15. The fold tabs are tightly interconnected as a result of heat sealing, in the region of the inner rear wall 15 in the manner of a fin seam which is placed against the inner pack 12 after sealing. In addition, a support member, in particular a tray, can be arranged inside the inner pack 12. Such an inner pack with tray is disclosed, for example, in former application WO2013/053408A1, to which reference is made for the purposes of complete disclosure.

A characteristic consists in that the removal opening 19 is at least partially free, that is to say without the opening tab located in the region of the removal opening 19 when preparing the blank 13. Said opening tab is part of the foil in the region of the removal opening 19. In the case of the exemplary embodiments, the opening tab is totally eliminated. The blank 13 is accordingly provided with a recess which forms the removal opening 19 in the case of the finished inner pack 12. As an alternative to this, a U-shaped punching can be provided in the blank 13 to form an opening. The created opening tab then remains connected to the blank 13 along an edge and is folded out of the region of the removal opening 19 and is placed against a wall of the inner pack, as a rule against an inside surface of the inner rear wall 15. A free opening is also accordingly formed in this case as removal opening 19.

A further characteristic is the realization of the glue regions or of the glue pattern for releasably connecting the closure means to the inner pack 12. As can be seen, in particular in FIG. 6, the closure means is provided with a glue pattern which is realized in a frame-like manner and surrounds the removal opening 19. This can be provided on the closure flap 20 (consisting of a separate blank) and/or on the blank 13 during the production.

The glue pattern (preferably PSA adhesive), in particular with edge strips 22, 23, 24, is realized with varying adhesive action, corresponding to the load when opening or closing the inner pack 12. At least the edge strip 22 is preferably realized with less adhesive action than the remaining portions of the glue pattern. In the present case, regions of the edge strips 23, 24 are also realized with less adhesive action so that in particular the introduction of the opening operation is made easier for the closure means. The further parts of the glue pattern, namely the anchoring strip 21, is realized with greater adhesive action in order to ensure the permanent fixing of the closure means on the inner pack 12.

The various holding or connecting effects of the regions of the glue pattern can otherwise be brought about as a result of selecting the various glue types correspondingly and/or as a result of various layer depths and/or as a result of various structures.

Said design of the glue connection between the closure flap 20 and the foil block 11 can also be applied in the case of conventional (sealing) packs and in the case of packs corresponding to FIG. 11 to FIG. 14. The conventional packs addressed can be such where the opening tab 35 remains in the initial position and is connected to the closure flap 20.

Figure 6:
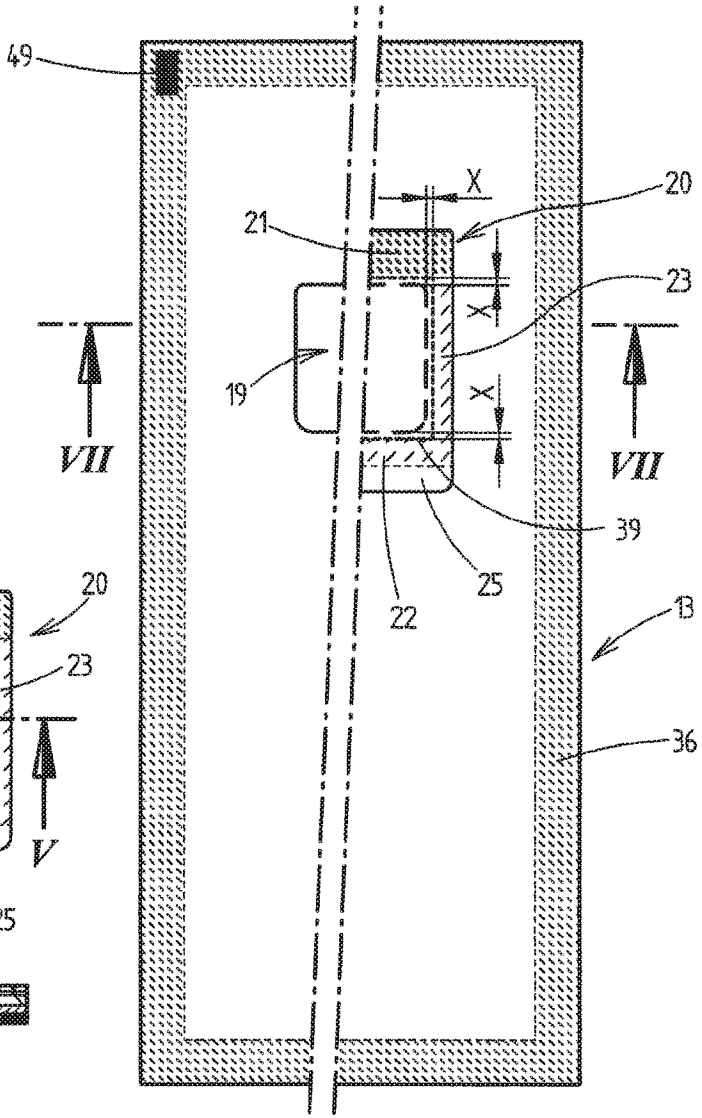
FIG. 6 shows a blank for the inner pack with closure means.

A further characteristic relates to the design of the blank 13 from multiple layers which are fixedly interconnected. In the present case, the blank 13 consists of at least three layers, namely an inner paper layer 33, a middle metallized layer 34 (for example aluminum) and an outer layer 35 produced from plastics material (for example PET). Said design ensures that the blank 13 is moisture-tight and aroma-tight and is able to be closed by sealing. A cold sealing method can preferably be used, in this case, as a sealing method. FIG. 6 shows the arrangement of a corresponding adhesive zone 36 which extends circumferentially at the edge of the blank 13.

A further characteristic consists with regard to the design of the closure flap 20 as closure means. An adhesive layer 38 is provided on the bottom of an upper plastics material layer 37. This also serves for fastening a further blank 39 in the region of the removal opening 19.

In the present case, the blank 39 consists of two layers, namely one inner paper layer 40 and one metalized layer 41 arranged between the paper layer 40 and the closure flap 20. Correspondingly, the design of the blank 39 corresponds to the design of the blank 13 with the exception of the missing plastics material layer. A layer of a different pulp can also be provided in place of a paper layer 40.

Figure 3:
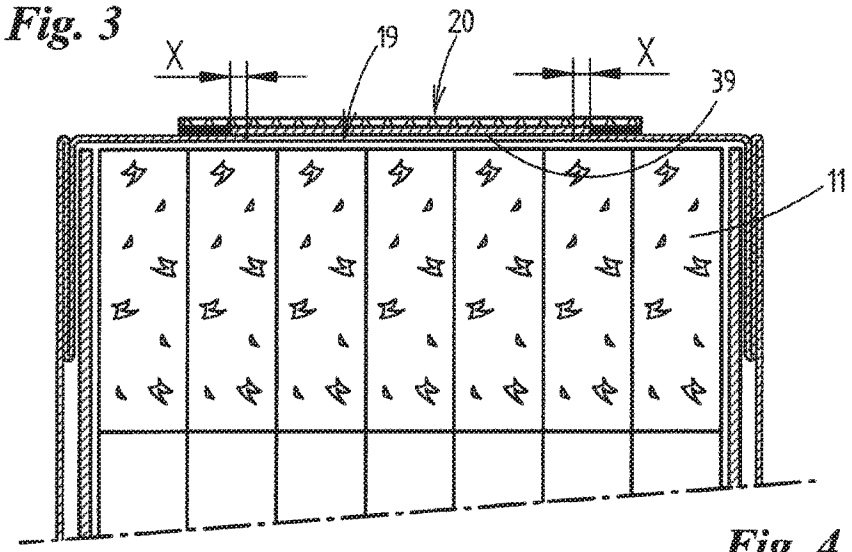
FIG. 3 shows a vertical section through the inner pack along cutting line III-III in FIG. 1.
Figure 4:
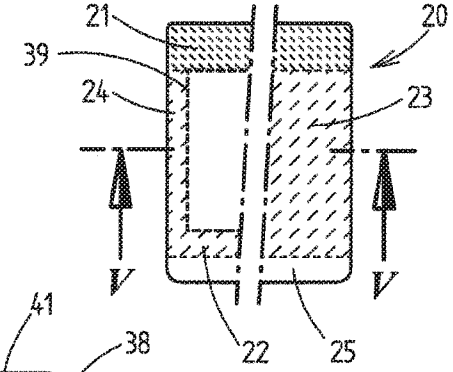
FIG. 4 shows a blank for a closure means of the inner pack.
Figure 5:
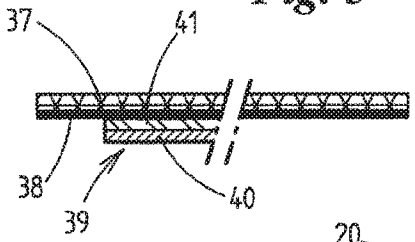
FIG. 5 shows a section through the closure means along cutting line V-V in FIG. 4.
Figure 7:
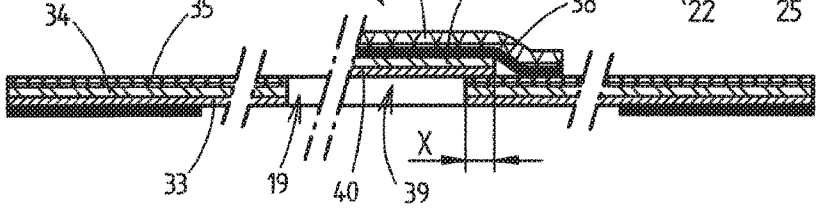
FIG. 7 shows a section through the blank along cutting line VII-VII in FIG. 6.

The arrangement or extension of the blank 39 is also important. The shape of the blank 39 is adapted to the form of the removal opening 19, however the blank 39 projects a little over the edge of the removal opening 19 on all sides beyond said removal opening so that the blank 39 overlaps the removal opening 19 or the edge thereof circumferentially by the amount "X" (see FIGS. 3, 6 and 7). The overlap can be, for example, a few millimeters. The important point is that the size of the overlap is such that in this way impairment of the pack contents by substance possibly emerging from the adhesive layer 39 of the closure flap 20 is counteracted.

Furthermore, the closure flap 20 naturally also overlaps the blank 39, namely once again on all sides or circumferentially such that a moisture-tight and aroma-tight closure of the removal opening 19 is ensured by the closure flap 20.

An apparatus which is suitable for arranging a closure flap 20 as closure means and a blank 39 on a continuous material web 42 for blanks 13, is described below with reference to FIG. 8. In this case, a continuous material web 42 for blanks 13 is transported along a transport section 43 and during the transport is provided with closure flaps 20 and blanks 39 in the region of the removal openings 19.

In a first operating step, the removal opening 19 is provided on the material web 42. This is effected in the region of a hole cutting apparatus 44. In the present case, the hole cutting apparatus 44 consists of a pair of rollers which are arranged on different sides of the material web 42. On the circumference, the rollers preferably have cutting means, by way of which the removal openings 19 are able to be provided. Any waste 45 possibly created is removed by means of a suction device 46. The hole cutting apparatus 44 can be driven by means of a servomotor 47.

A sensor, in particular a print mark sensor, is arranged upstream of the hole cutting apparatus 44, by way of which sensor print marks 49 provided on the material web 42 are able to be scanned in order to arrange the position of the removal opening 19 correspondingly.

Once the removal opening 19 has been provided, the material web 42 passes into the region of an application roller 50 which interacts with a pressing roller 51 which is arranged on the other side of the material web. A sensor 52 is once again arranged upstream of the application roller 50 in order to make it possible to arrange the closure flap 20 in a positionally accurate manner on the material web 42.

The sensor 52 can either scan the already mentioned print mark 48 or can scan the removal opening 19 directly.

The application roller 50 serves for the purpose of providing closure flaps 20 with a blank 39 arranged thereon on the material web 42. The supplying of the closure flaps 20 and of the blanks 39 will be described subsequently. The material web 42, provided with closure flaps 20 and blanks 39, is then guided past a pressing member 53 and is then checked by way of another sensor 54, in particular with regard to the correct position and/or provision of the closure flap 20 etc.

The closure flaps 20 are supplied from a bobbin 56 on a continuous carrier strip 55, on which they are arranged spaced apart from one another, and are deflected in the region of a drive roller 57. An equalizing pendulum 58, which the carrier strip 55 runs through, connects thereto at a spacing.

In the region of the deflection 59, the carrier strip 58 is sharply deflected and, guided by means of a further drive roller 59 and a further equalizing pendulum 61, is wound on a further bobbin 62. As a result of the deflection, the closure flaps 20 are detached individually from the carrier strip 55 and pass to the circumference of the application roller 50, where they are preferably held by means of negative pressure. Blanks 39 are supplied by means of a transfer roller 63, which is arranged adjacent to the application roller 50, in a positionally accurate manner and are pressed against the closure flaps 20 situated on the pressing roller 51.

Figure 8:
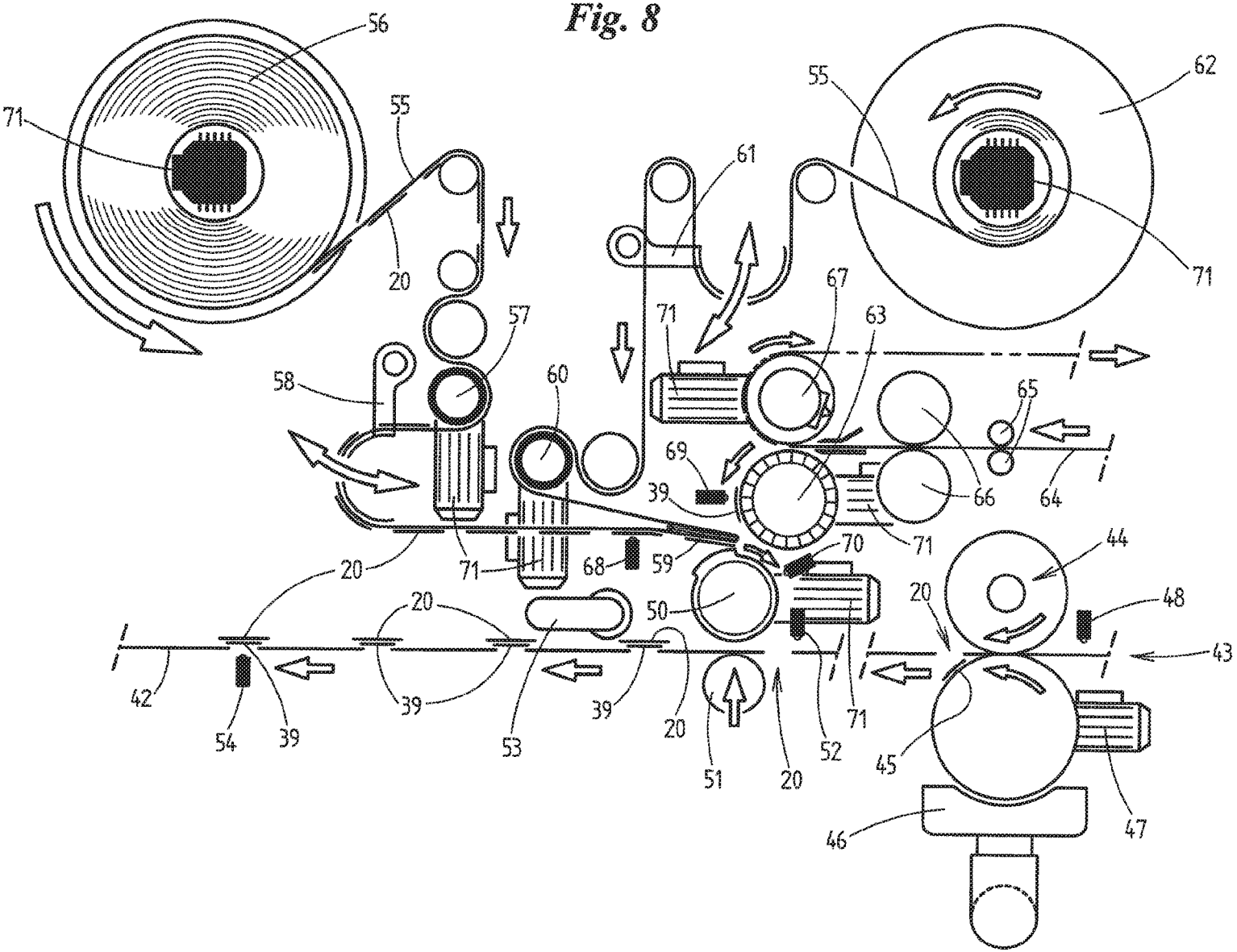
FIG. 8 shows a schematic side view of part of an apparatus for producing packs for cigarettes, FIG. 9 a representation corresponding to FIG. 1 of a second example of a closed inner pack.
Figure 10:
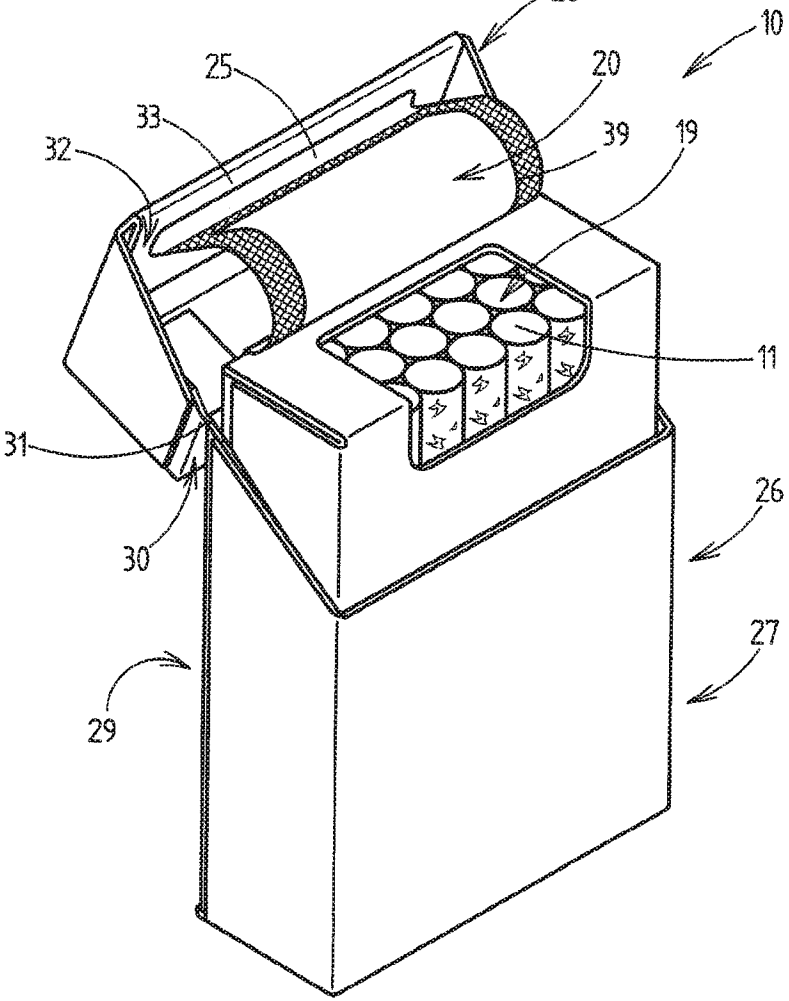
FIG. 10 shows an open inner pack according to FIG. 9 in an outer pack with an open lid.
Figure 9:
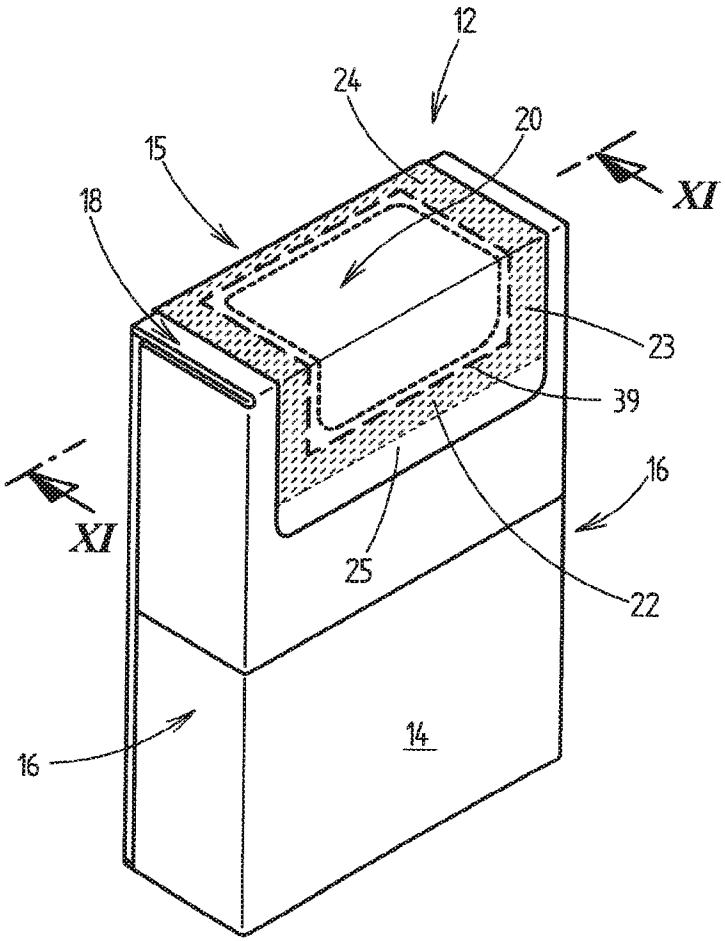
Figure 12:
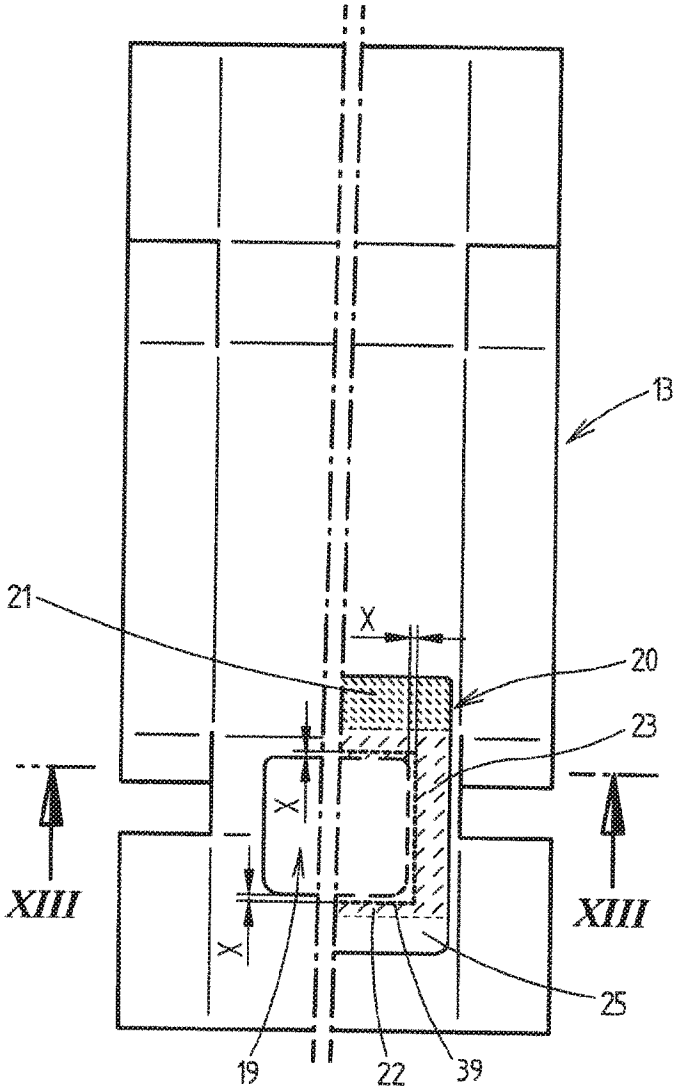
FIG. 12 shows a blank for the inner pack according to FIG. 9 with closure means.
Figure 11:
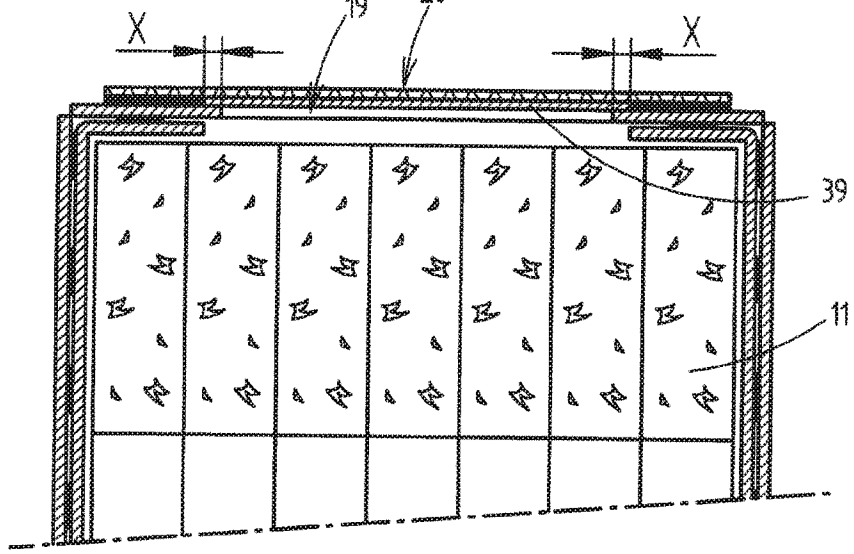
FIG. 11 shows a vertical section through the inner pack according to FIG. 9 along cutting line XI-XI in FIG. 9.
Figure 13:
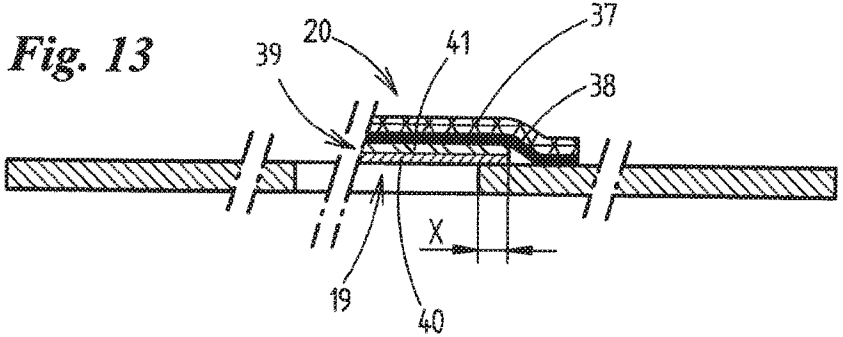
FIG. 13 shows a section through the blank along cutting line XIII-XIII in FIG. 12.

The blanks 39 can either be taken out of a continuous material web 64, as shown in FIG. 8. In this case, the material web 64 is first of all guided by means of transport rollers 65 and transported by means of a pair of feeding rollers 66 into the region of a cutting unit 67, where individual blanks 39 are taken out of the material web 64 and transferred to the transfer roller 63. The blanks 39 are held there on the circumference by means of negative pressure. The remaining material web 64 is then wound onto the cutting unit 67 again. Insofar as the blanks 39 are able to be taken out of the material web 64 without any waste, said step is naturally able to be omitted.

Further sensors are arranged inside the apparatus in order to be able to monitor or control the situationally accurate or positionally accurate merging of the individual parts. To this end, a sensor 68, which serves for detecting the closure flaps 20 on the carrier strip 55, is arranged upstream of the deflection 59. A sensor 69, which serves for detecting the situation of the blanks 39 on the transfer roller 63, is assigned to the transfer roller 63. A sensor 70 is arranged on the circumference of the application roller 50 following the merging of blank 39 and closure flap 20 in order to detect the situation of the closure flap 20 on the application roller 50. The apparatus is driven by diverse servomotors 71. The data determined by the sensors can be evaluated by means of a suitable control unit and the apparatus can be controlled by controlling the servomotors such that the closure flaps 20 and blanks 39 are positioned in a situationally correct manner in the region of the removal openings 19.

FIGS. 9 to 13 show a second exemplary embodiment of a pack 10. Said second exemplary embodiment differs from the first shown exemplary embodiment substantially only by the design of the inner pack 12. The inner pack 12 is formed from a thin cardboard which can be coated with a dense material. Reference is made to EP 2 310 300 A1 of the applicant with regard to the details. A closure flap 20 with an additional blank 39 is also provided as in the first exemplary embodiment in the case of said inner pack 12.

Figure 14:
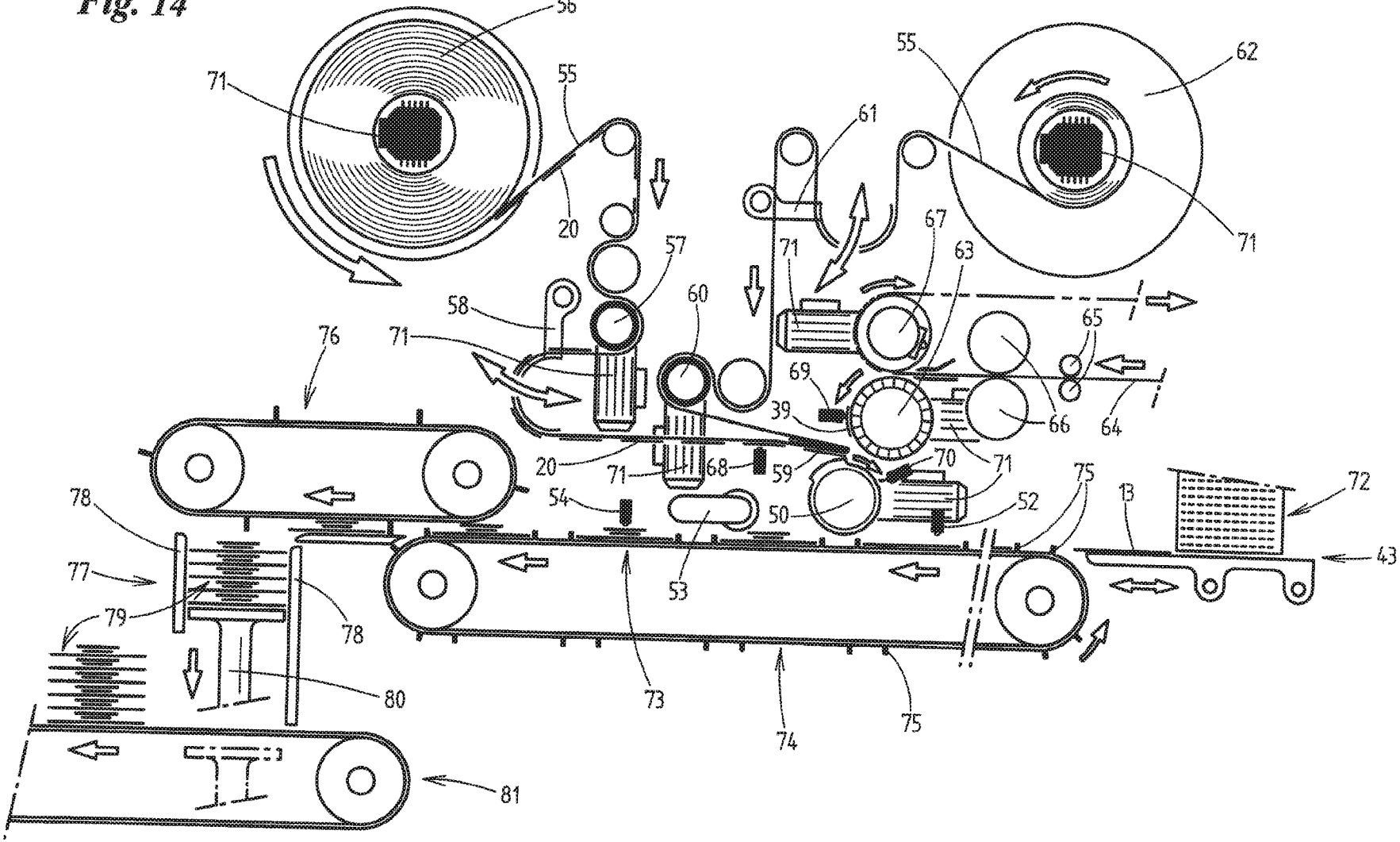
FIG. 14 shows a schematic side view of part of a second apparatus for producing packs for cigarettes.

FIG. 14 shows a corresponding apparatus analogously to the first exemplary embodiment. The supplying of the closure flaps 20 and blanks 39 is effected, in this case, in the same way as in the first exemplary embodiment. However, the blanks 13 for the inner pack 12 are not taken from a continuous material web 43 but are removed individually from a blank hopper 72 and transferred to an upper run 73 of an endless conveyor 74 which is arranged in the transport section 43.

The blanks 13 lie flatly on the upper run 73 and are held between entrainment means 75 of the endless conveyor 74.

Following the providing of the closure flaps 20 with blank 39, the pressing member 53 and the sensor 54, the blanks 13 are transported into the region of a stacking device 77 by means of a pulling conveyor 76, where a stack 79 of blanks 13, the bottom side of which rests on a lifting member 80 which is movable in the vertical direction, is formed between lateral guides 78.

The stacks 79 are transferred from the stacking device 77 to a further pulling conveyor 81, by way of which the stacks 79 are removed.

The stacks 79 can be stored initially for subsequent processing in a packing machine and processed directly in said packing machine.

LIST OF REFERENCES

10 Pack
11 Cigarette
12 Inner pack
13 Blank
14 Inner front wall
15 Inner rear wall
16 Inner side wall
17 Inner bottom wall
18 Inner end-face wall
19 Removal opening
20 Closure flap
21 Anchoring strip
22 Edge strip
23 Edge strip
24 Edge strip
25 Actuating flap
26 Outer pack
27 Box part
28 Lid
29 Box rear wall
30 Lid rear wall
31 Line joint
32 Lid front wall
33 Paper layer
34 Metallized layer
35 Outer layer
36 Adhesive zone
37 Plastic material layer
38 Adhesive layer
39 Blank
40 Paper layer
41 Metalized layer
42 Material web
43 Transport section
44 Hole cutting apparatus
45 Waste
46 Suction device
47 Servomotor
48 Sensor
49 Print mark
50 Application roller
51 Pressing roller
52 Sensor
53 Pressing member
54 Sensor
55 Carrier strip
56 Bobbin
57 Drive roller
58 Equalizing pendulum
59 Deflection
60 Drive roller
61 Equalizing pendulum
62 Bobbin
63 Transfer roller
64 Material web
65 Transport rollers
66 Feed rollers
67 Cutting unit
68 Sensor
69 Sensor
70 Sensor
71 Servomotor
72 Blank hopper
73 Upper run
74 Endless conveyor
75 Entrainment means
76 Pulling conveyor
77 Stacking device
78 Guide
79 Stack
80 Lifting member
81 Pulling conveyor

What is claimed is:

1. A pack for cigarettes (10) having an outer pack (26) and having an inner pack (12) with a blank (13) produced from packing material which surrounds at least one cigarette group as pack contents, wherein the inner pack (12) comprises a removal opening (19) for accessing the pack contents, and wherein the inner pack (12) comprises a closure means which is fastened to the inner pack (12) by means of an at least partially releasable adhesive bond and is removable from the inner pack (12) for access to the removal opening (19) or to the pack contents, wherein:

for forming the removal opening (19), the blank (13) comprises an opening which is closable by the closure means;

the closure means comprises a coverage region which, with the closure means in the closed position, surrounds the opening on all sides or circumferentially and is connectable by means of adhesion to a region of the blank (13) which surrounds the opening circumferentially; and a separate blank (39) produced from packing material is fastened by means of adhesion on the closure means on the side pointing to the inner pack (12), the separate blank (39), with the closure means in the closed position, covering the opening entirely and projecting beyond an edge of the opening on all sides with an overlap region (X).

2. The pack as claimed in claim 1, wherein the blank (39), which is provided on the closure means, comprises smaller dimensions than the closure means, wherein the closure means overlaps the blank (39) on all sides or circumferentially in such a manner that the closure means is bondable to the inner pack (12) all around the blank (39).

3. The pack as claimed in claim 1, wherein the closure means is provided with an adhesive layer (38) on the side surface pointing to the inner pack (12), wherein the adhesive layer (38) extends over the entire side surface and only an actuating flap (25) of the closure means is glue-free.

4. The pack as claimed in claim 3, wherein the adhesive layer (38) comprises regions of varying intensity or strength of adhesion in such a manner that in a region of the beginning of the opening, when the closure means is actuated, an adhesive zone with a comparatively weaker adhesive action is realized, followed by an adhesive zone with a comparatively stronger adhesive action and a further adhesive zone with a higher adhesive action.

5. The pack as claimed in claim 1, wherein the closure means or an actuating flap (25) of the closure means is connected permanently to the inside surface of a lid front wall (32) of the outer pack (26) by means of a glue strip and/or glue dots on the free outside surface of the actuating flap (25).

6. The pack as claimed in claim 1, wherein the blank (39) on the side pointing to the cigarette group comprises a layer produced from a pulp.

7. The pack as claimed in claim 6, wherein the blank (39) on the side pointing to the cigarette group comprises a paper layer (40).

8. The pack as claimed in claim 1, wherein the outer pack (26) is structured as a hinge-lid pack with a box part (27) and a lid (28) which is mounted on the box part (27) so as to be pivotable.

9. The pack as claimed in claim 1, wherein the closure means is structured as a closure flap (20).

10. A method for producing a pack (10) for cigarettes (11) having an outer pack (26) and having an inner pack (12) with a blank (13) produced from packing material which surrounds at least one cigarette group as pack contents, wherein the inner pack (12) comprises a removal opening (19) for accessing the pack contents, and wherein the inner pack (12) comprises a closure means which is fastened to the inner pack (12) by means of at least one partially releasable adhesive bond and is removable from the inner pack (12) for access to the removal opening (19) or to the pack contents, comprising:

first of all providing a removal opening (19) on the blank (13); and in a next step providing the closure means for the removal opening (19) in a situationally correct manner (19) on the blank (13) in the region of the removal opening (19), wherein, prior to the provision of the closure means to the blank (13) for the inner pack (12), providing a separate blank (39) produced from packing material on the closure means in such a manner that, once the closure means has been provided to the blank (13), the blank (39) covers the removal opening (19) on all sides or circumferentially and the blank (39) is covered on all sides or circumferentially by the closure means.

11. The method as claimed in claim 10, further comprising monitoring the situationally correct provision of the blanks (39) on the closure means, on the one hand, and the situationally correct provision of the closure means on the blanks (13), on the other hand, by sensors and correspondingly controlling drives of members of the packing machine for transporting the closure means and/or the blanks (13, 39) for the situationally correct provision.

12. The method as claimed in claim 11, further comprising detaching the closure means from a continuous carrier strip (55) as a result of deflection of the carrier strip (55) and are transferred to an application roller (50), wherein the closure means are transported in such a manner on the application roller (50) that a side of the closure means provided with adhesive is remote from the surface of the application roller (50), and in that blanks (39) are transferred to the closure means located on the application roller (50) and are fastened thereto as a result of bonding.

13. The method as claimed in claim 12, further comprising providing the interconnected closure means and blanks (39) by the application roller (50) on a continuous material web (42) for blanks (13) for the inner pack (12) or on individual blanks (13) for the inner pack (12), namely in a situationally correct manner at the openings, provided in the material web (42) or the blanks (13), for the removal opening (19).

14. An apparatus for producing a pack (10) for cigarettes (11) having an outer pack (26) and having an inner pack (12) with a blank (13) produced from a packing material which surrounds at least one cigarette group as pack contents, wherein the inner pack (12) comprises a removal opening (19) for accessing the pack contents, and wherein the inner pack (12) comprises a closure means which is fastened to the inner pack (12) by means of at least one partially releasable adhesive bond and is removable from the inner pack (12) for access to the removal opening (19) or to the pack contents, comprising:

a hole cutting apparatus (44) for providing a removal opening (19) on the blank (13); and an application roller (50) which is arranged downstream of the hole cutting apparatus (44) for providing the closure means on the blank (13) in the region of the removal opening (19), wherein a separate blank (39) produced from packing material is providable on the closure means on the application roller (50) in such a manner that, once the closure means has been provided on the blank (13), the blank (39) covers the removal opening (19) on all sides or circumferentially and the blank (39) is covered on all sides or circumferentially by the closure means.

15. The apparatus as claimed in claim 14, wherein the blank (39) is suppliable by means of a transfer roller (63) to the closure means held on the application roller (50).

16. The apparatus as claimed in claim 14, wherein the supplying of the closure means to the application roller (50) is controllable by means of a sensor and/or in that the supplying of the blank (39) to the application roller (50) is controllable by means of a sensor and/or in that the supplying of the closure means with the application roller (50) is controllable by means of a sensor and/or in that the supplying of the blanks (13) or of a corresponding material web (42) into the region of the application roller (50) is controllable by means of a sensor.

17. The apparatus as claimed in claim 16, wherein members of the apparatus are controlled by drive motors in accordance with the data acquired by the sensors in such a manner that the closure means with blanks (39) mounted thereon are arranged in a situationally correct manner in the region of the removal opening (19).

* * * * *